United States Patent [19]

Nesse

[11] Patent Number: 4,569,089

[45] Date of Patent: Feb. 11, 1986

[54] JACKET/VEST

[76] Inventor: Gary E. Nesse, 2945 Hilltop Dr., Missoula, Mont. 59803

[21] Appl. No.: 658,885

[22] Filed: Oct. 9, 1984

[51] Int. Cl.[4] ..... A41D 1/02; A41D 1/04; A41B 1/08

[52] U.S. Cl. ..... 2/108; 2/102; 2/126

[58] Field of Search ..... 2/69, 69.5, 108, 102, 2/126

[56] References Cited

U.S. PATENT DOCUMENTS

| | | | |
|---|---|---|---|
| 4,006,495 | 2/1977 | Jones | 2/126 |
| 4,302,850 | 12/1981 | Maeshima | 2/108 |
| 4,347,629 | 9/1982 | Itoi | 2/69.5 |

*Primary Examiner*—Doris L. Troutman

*Attorney, Agent, or Firm*—Gunn, Lee & Jackson

[57] ABSTRACT

A garment which converts from a jacket to a vest and vice versa. The garment has retractable sleeves which are rolled or folded into sleeve storage compartments which encircle the arm holes. In one embodiment, the sleeves have a longitudinal slit which runs the length thereof to facilitate folding for storage in the compartment. The garment has a retractable hood which stores in a hidden compartment in the collar. The garment has one or more retractable safety panels which can be colored international orange and/or have enhanced light reflective properties. The safety panels cover a substantial portion of the back of the garment when in use. The garment has a day pack as an integral part thereof. The garment has means to adjust the fit around the midsection of the torso by constriction of the garment.

32 Claims, 9 Drawing Figures

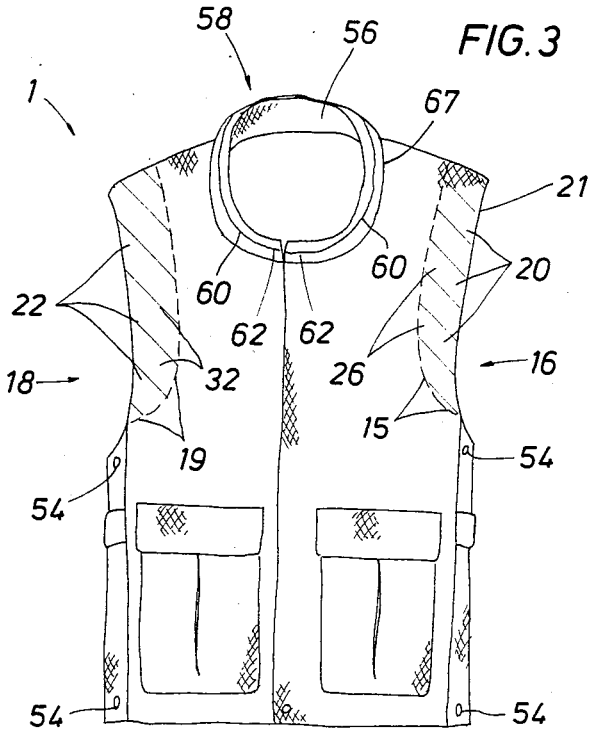
FIG. 3
FIG. 5
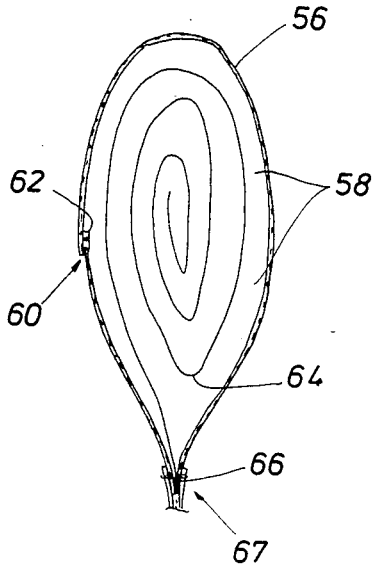
FIG. 4
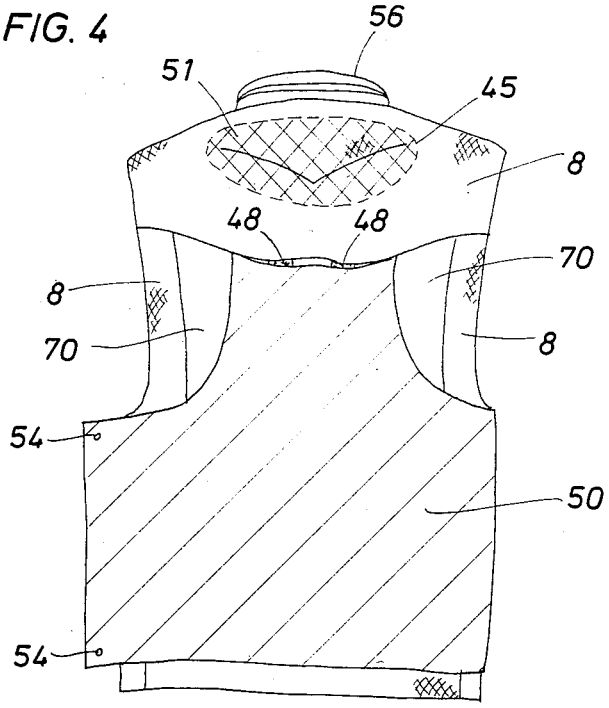
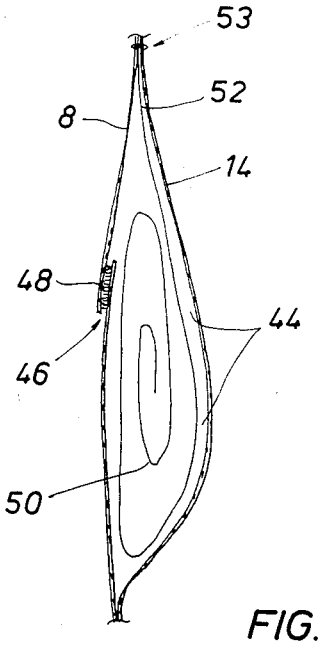
FIG. 6

FIG. 7
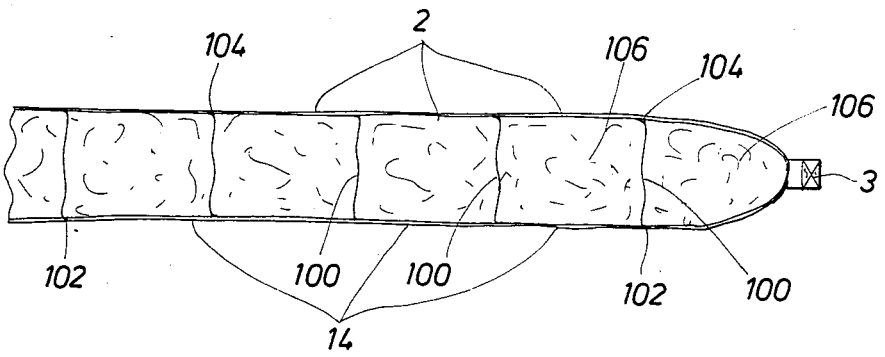
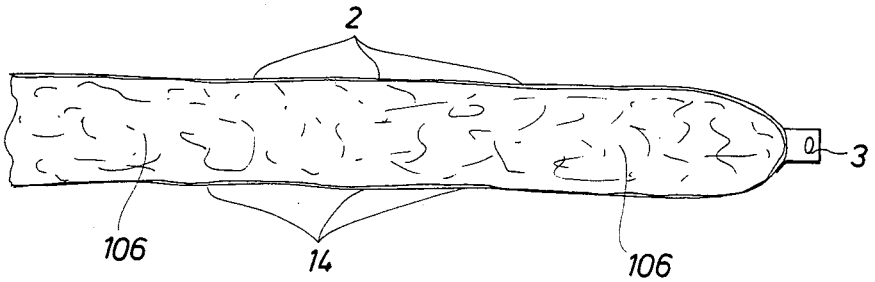
FIG. 8
FIG. 9
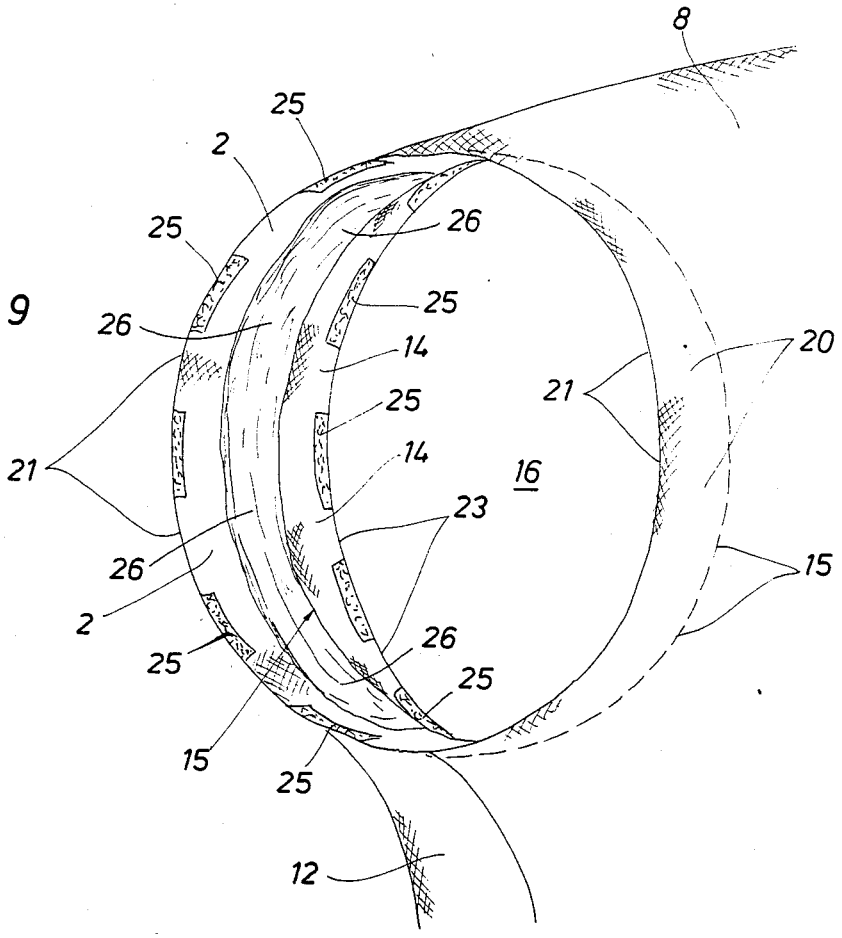

JACKET/VEST

BACKGROUND OF THE DISCLOSURE

1. Class of the Invention

This invention relates to apparel and haberdashery in Class 2.

2. Prior Art

The present invention is a combination of many useful features not heretofore combined in a single garment. This jacket/vest is ideally suited for bicycling, jogging, golfing, skiing, hunting, fishing and other outdoor events.

Numerous inventions are thought to be patented which show convertible types of clothing such as U.S. Pat. No. 4,068,316 for a convertible shirt. The sleeves of the convertible shirt are completely detachable and are subject to being lost or misplaced. The sleeves of the present invention are permanently attached to the garment and are retractable rather than removable.

Other features are combined into the jacket/vest which markedly increase its utility. A retractable hood is concealed within the collar. A day pack is an integral part of the back side of the garment.

A retractable safety panel is stored on the back of the garment inside a safety panel storage compartment. This panel can be colored international orange or any other highly visible color. This panel covers a substantial portion of the rear of the garment which makes joggers, cyclists, or any person using congested roads or pathways more visible. This panel is of particular interest to hunters where regulations and safety require high visibility. When the wearer of the jacket/vest is not engaged in outdoor activities, the safety panel can be retracted into its storage compartment thereby improving the appearance of the garment. In an alternative embodiment, a second safety panel which has enhanced light reflective properties further increases the utility of the garment for those engaged in nighttime activities. This unique combination presents an array of useful features not present in a single garment in the prior art.

SUMMARY OF THE DISCLOSURE

A garment which converts from a jacket to a vest and vise-versa is disclosed. The garment has retractable sleeves which may be hidden from view in sleeve storage compartments which encircle the arm holes. The garment has a retractable hood which stores in a hidden compartment in the collar. The garment has one or more retractable safety panels which can be colored international orange and/or have enhanced light reflective properties. The garment has a day pack as an integral part thereof. The garment has means to adjust the fit around the midsection of the torso by constriction of the garment.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

FIG. 3 is a front view of the garment with sleeves and hood in retracted position.

FIG. 4 is a rear view of the garment with sleeves and hood in retracted position and a safety panel in fully extended position.

FIG. 5 is a cross section of the collar showing the hood retracted in its storage compartment.

FIG. 6 is a cross section of a safety panel storage compartment showing the safety panel retracted therein.

FIG. 7 is a cross section of the shell lining and baffles with thermal insulation inbetween.

FIG. 8 is a cross section of the shell and lining with thermal insulation inbetween.

FIG. 9 is a rear view of the left arm hole with the sleeve storage compartment open showing the sleeve retracted therein.

DESCRIPTION OF THE PREFERRED EMBODIMENT

Figure 1:
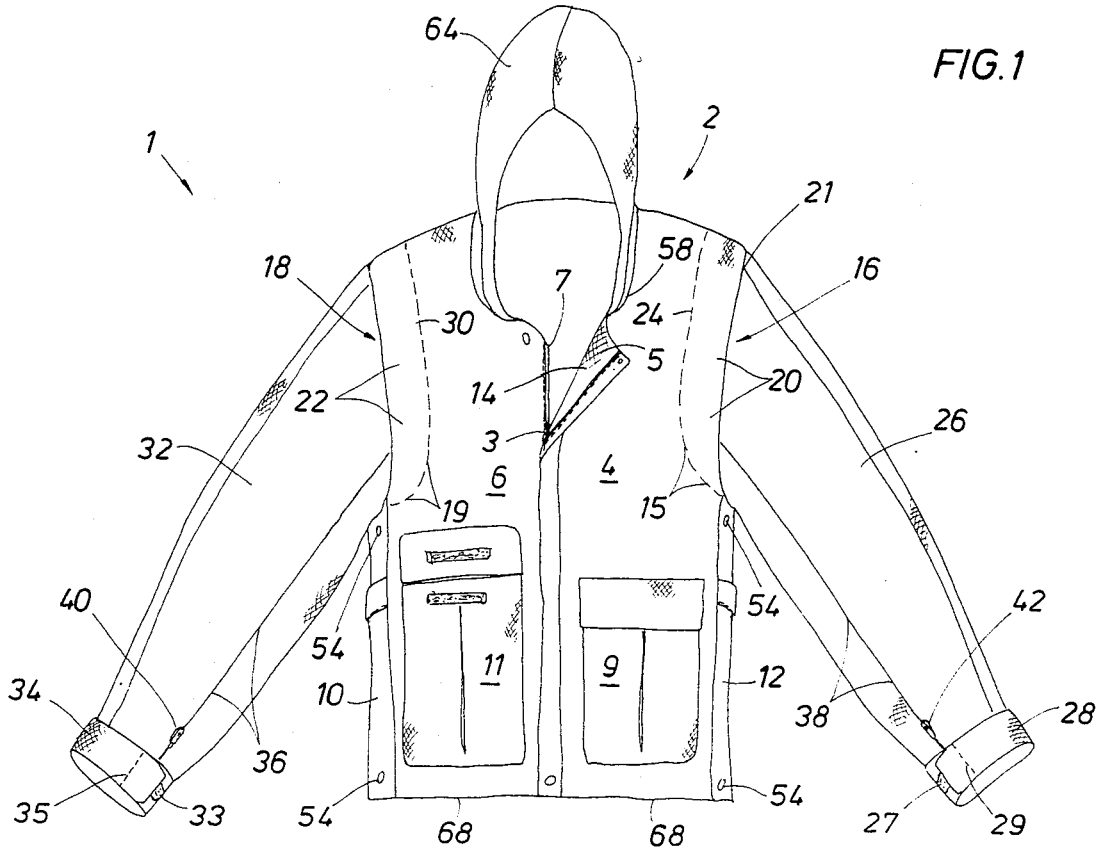
FIG. 1 is a front view of the garment with sleeves and hood in fully extended position.

In FIG. 1 the garment is generally designated by the numeral 1. The garment has an exterior shell generally designated by the numeral 2 which can be of one piece design or composed of several different panels. The garment 1 of FIG. 1 uses the multiple panel approach.

Figure 2:
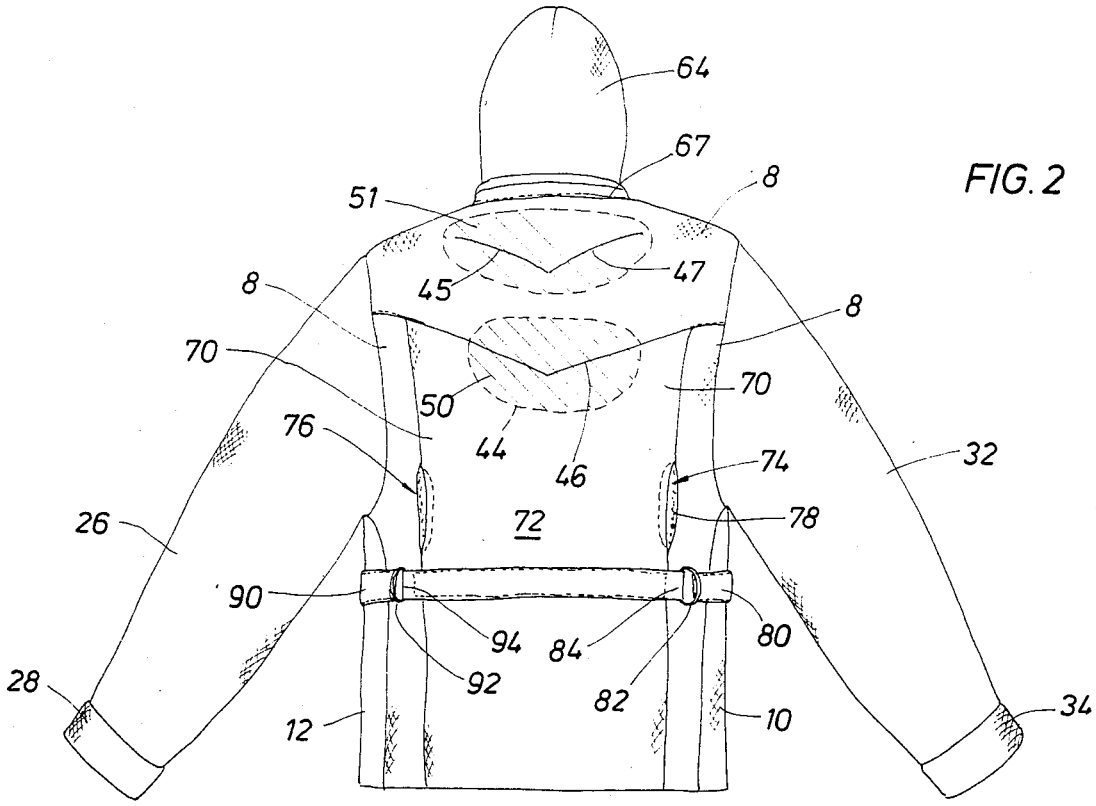
FIG. 2 is a rear view of the garment with sleeves and hood in fully extended position and safety panels in retracted position.

The exterior shell 2 has a left front panel 4, a right front panel 6, and a back panel 8 which is more clearly shown in FIG. 2. A zipper 3 or other suitable fastening means is attached to the edge 5 of left front panel 4 and the edge 7 of right front panel 6. An exterior pocket 9 is attached to left front panel 4. An exterior pocket 11 is attached to right front panel 6.

In between the right front panel 6 and the back panel 8 is the right side panel 10. In between the left front panel 4 and the back panel 8 is the left side panel 12. A plurality of buttons 54 or other suitable fastening means are attached to the left and right side panels to detachably connect a safety panel 50 which will be more fully explained with reference to FIG. 2.

The interior shell or lining 14 is attached to the interior side of the shell 2 at various points which are primarily a matter of manufacturing convenience; however, they will at least be attached along the edges of the collar seam 67, the edges 5 and 7 along the center front opening, and the torso seam 68.

A left arm hole 16 and a right arm hole 18 are found at the respective shoulders of garment 1. A left sleeve storage compartment 20 is shown in phantom encircling the left arm hole 16. A right sleeve storage compartment 22 is shown in phantom encircling the right arm hole 18. The sleeve storage compartments are formed between the exterior shell 2 and the lining 14. The lining 14 is attached to the shell 2 around the left arm hole 16 at a recessed seam 15 shown in phantom. The lining 14 is also attached to the shell 2 around the right arm hole 18 at a recessed seam 19 shown in phantom. A first circumferential lip 21 is formed on the outer edge of the exterior shell 2 encircling the left arm hole 16. A second circumferential lip 23 (better seen in FIG. 9) is formed on the outer edge of the interior shell or lining 14 encircling the left arm hole 16. The right arm hole 18 and sleeve storage compartment 22 are similar to the left storage compartment 20, but have as an opposite configuration to adapt to the right arm. The first circumferential lip 21 and the second lip 23 are fitted with Velcro tape 25 or other suitable fastening means to open and close the sleeve storage compartments which will be more fully explained with reference to FIG. 9.

The base 24, not shown, of left sleeve 26 is permanently attached to the interior of sleeve storage compartment 20. On the opposite end of left sleeve 26 is cuff 28. The base 30, not shown, of right sleeve 32 is permanently attached to the interior of sleeve storage compartment 22. On the opposite end of right sleeve 32 is cuff 34. Cuff 28 has a slit 29 shown in phantom therein so that the cuff can be opened and closed. Velcro tape 27 or other suitable fastening means is attached to cuff 28. Cuff 34 has a slit 35 shown in phantom therein so that the cuff can be opened and closed. Velcro tape 33, or other suitable fastening means is attached to cuff 34. A slit 36 runs the length of right sleeve 32 from the cuff 34 to the base 30. Likewise a slit 38 runs the length of left sleeve 26 from the cuff 28 to the base 24. A zipper 40 or other suitable fastening means runs the length of slit 36. A zipper 42 or other suitable fastening means runs the length of slit 38. A retractable hood 64 extends from the hood storage compartment 58 concealed within collar 56.

In FIG. 2, a safety panel storage compartment 44, shown in phantom, is formed between the back panel 8 and the lining 14. The entrance 46 to the safety panel storage compartment 44 is located on the back panel 8. The exact location of the entrance 46 is a matter of manufacturing convenience. Velcro tape 48, better seen in FIG. 4, or other suitable fastening means is located in the entrance 46 to open and close the storage compartment 44. A retractable safety panel 50, shown by shading, with a base 52 is permanently attached to the interior of the storage compartment 44. In FIG. 2, the safety panel 50 is in a retracted position, folded inside storage compartment 44. FIG. 4 shows the panel 50 in fully extended position. A plurality of buttons 54 or other suitable means are used to detachably connect the safety panel 50 to the shell 2. The safety panel 50 could be colored international orange for emergency situations or for hunter safety; it could also be a reflective panel for night cycling or other nighttime activities in which high visibility is helpful.

In an alternative embodiment, a second safety panel storage compartment 45, shown in phantom, could be added so that the first safety panel 50 could be colored international orange and a second safety panel 51, shown by shading, could have enhanced light reflective properties. The second storage compartment 45 has an entrance 47 located on back panel 8. Velcro tape 49 (not shown) or other suitable fastening means, is located in the entrance 47 to open and close the storage compartment 45. The base 53 of the second safety panel is permanently attached to the interior of the storage compartment 45.

A retaining panel 70 is permanently attached to the back panel 8. A general storage compartment or day pack 72 is formed between the retaining panel 70 and the back panel 8. The day pack 72 can be accessed through the right hand entrance 74 or the left hand entrance 76. Velcro tape 78 or other suitable fastening means is located in the entrances 74 and 76 to open and close the day pack 72.

The fit of this garment around the midsection of the torso can be adjusted by any of several suitable means which constrict the right side panel 10 and/or the left side panel 12. For example, elastic could be sewn into the side panels 10 and 12 which would result in a tight fitting garment. Other suitable means could be used; however, in the preferred embodiment, an adjustable strap 80 is used to achieve constriction of the right side panel 10. The adjustable strap 80 passes through two D-rings 82 which are mounted on a strap 84. The adjustable strap 80 is anchored at the same between the right side panel 10 and the right front panel 6. The strap 84 is anchored at the seam between the right side panel 10 and the back panel 8. The D-rings 82 releasably grasp and hold the strap 80 which can be adjusted according the desire of the person wearing the garment 1. Tightening strap 80 constricts the right side panel 10.

A second adjustable strap 90 passes through a second pair of D-rings 92 which are mounted on strap 94. The second adjustable strap 90 is used to adjust the left side panel 12. The second adjustable strap 90 is anchored at the seam between left side panel 12 and the left front panel 4. The strap 94 is anchored at the seam between the left side panel 12 and the rear panel 8. The D-rings 92 releasably grasp and hold the second adjustable strap 90. Tightening strap 90 constricts the left side panel 12.

In FIG. 3, a collar 56 attaches to the garment 1 at collar seam 67. A hood storage compartment 58 is concealed within collar 56. An entrance 60 to the storage compartment 58 encircles the exterior of collar 56. A zipper 62 or other suitable fastening means is located along the entrance 60 to open and close the storage compartment 58. A retractable hood 64 with a base 66 is permanently attached to the interior of the storage compartment 58. The hood is shown in retracted position in FIG. 3 and in the fully extended position in FIGS. 1 and 2. In FIG. 3, the sleeve storage compartments 20 and 22 are again shown in phantom view. The sleeve 26 is shown in phantom by shading in the retracted position folded inside of sleeve storage compartment 20. The sleeve 32 is shown in phantom by shading in the retracted position folded inside of sleeve storage compartment 22.

In FIG. 4, the retractable safety panel 50 is shaded and shown in fully extended view. The entrance 46 to the safety panel storage compartment is shown folded back exposing the Velcro tape 48. The plurality of buttons 54 are shown on the left hand side prior to attachment to the shell 2. On the right hand side, the safety panel 50 has already been attached by the plurality of buttons 54 to the shell 2.

The second safety panel storage compartment 45 is shown in phantom. The second safety panel 51 is shown in phantom by crosshatching in its retracted position inside the second compartment 45. Depending on the needs of the user, one safety panel at a time could be extended for use. For example, if panel 50 is international orange and panel 51 has enhanced light reflective properties, a cyclist may use the orange panel 50 during the day and the reflective panel 51 at night. In lieu of using a second reflective panel 51, reflectors could be attached to the first panel 50.

In FIG. 5, the collar 56 is shown in cross section. The hood 64 is shown in a retracted position folded in a circular fashion inside the hood storage compartment 58. The entrance 60 to the storage compartment is shown in a closed position with zipper 62 sealed. The base 66 of hood 64 is shown permanently attached to the collar seam 67.

In FIG. 6, the safety panel storage compartment 44 is shown in cross section. The safety panel 50 is shown in a retracted position folded in a circular fashion inside the compartment 44. The entrance 46 to the storage compartment 44 is shown in a closed position with Velcro tape 48. The base 52 of panel 50 is shown permanently attached inside the compartment 44 at the seam 53 found between the back panel 8 and the lining 14.

FIG. 7 is a sectional view of the space between the lining 14 and the shell 2. A plurality of baffles 100 have been inserted between the lining and shell. The baffles 100 are permanently attached to the lining 14 at a plurality of seams 102 and to the shell at a plurality of seams 104. A thermal insulator 106 is placed in the compartments formed between the lining 14, the shell 2 and the plurality of baffles 100.

FIG. 8 shows an alternate embodiment in section. The thermal insulator 106 is simply disposed between lining 14 and shell 2. The thermal insulator may be quilted to the lining 14 and/or the shell 2. It may also be held in place by attachment at the seam between the lining 14 and the shell 2.

In FIG. 9, a rear view of the left arm hole 16 is shown. The left sleeve 26 is shown in a retracted position rolled into storage compartment 20. The exterior shell 2 is joined to the interior shell or lining 14 along recessed seam 15 which encircles arm hole 16. A first circumferential lip 21 is formed on the outer edge of the exterior shell 2 encircling left arm hole 16. A second circumferential lip 23 is formed on the outer edge of the interior shell 14 encircling the left arm hole 16. A plurality of pieces of Velcro tape 25 or other suitable fasteners are positioned about the lips 21 and 23. In FIG. 9, the lips 21 and 23 are separated from each other to clearly show the sleeve 26 in its retracted position. When the tape 25 is sealed the sleeve 26 is hidden from view in the sleeve storage compartment 20. The right arm hole 18 and sleeve storage compartment 22 are similar to left sleeve storage compartment 20 but have an opposite configuration to adapt to the right arm.

It should be understood from the foregoing that it is possible to assemble a garment without an interior shell or lining 14 for warm weather applications. In such applications, the sleeve storage compartments 20 and 22 could be formed in a pocket between the exterior shell and a flap sewn along the recessed seams 15 and 19. The use of such flaps instead of an interior shell or lining 14 would be within the spirit of this invention.

While the foregoing is directed to the preferred embodiment of the present invention, other and further embodiments of the invention may be devised without departing from the basic scope thereof, and the scope thereof is determined by the claims which follow:

I claim:

1. A garment which converts from a long sleeve jacket to a vest comprising:

a shell having a back panel, a left front panel, and a right front panel;

a lining on the interior of said shell;

a pair of circumferential compartments encircling the arm holes formed between said shell and said lining, having a first circumferential lip at the outer edge of said shell encircling said arm holes, and a second circumferential lip at the outer edge of said lining encircling said arm holes;

means to open and close said first and second lips around each of said circumferential compartments;

a pair of retractable sleeves with a circular hand opening at one end and a circular shoulder opening at the other end; said sleeves being rolled for storage in said circumferential compartments when not in use;

a third circumferential lip formed at the outer edge of each of said sleeves along said circular shoulder opening, said third lip being permanently attached along the entire circumference of said third lip inside each of said circumferential compartments;

a slit in each of said sleeves running their longitudinal length from said hand opening to said shoulder opening; and means to open and close each of said slits.

2. The garment of claim 1 including:

a safety panel storage compartment, with an entrance on said back panel of said shell;

means to open and close said entrance to said safety panel storage compartment;

a retractable safety panel with a base permanently attached to the interior of said safety panel storage compartment, said safety panel being retracted into said safety panel storage compartment when not in use; and means to removably attach said safety panel to said shell when not retracted in said safety panel storage compartment.

3. The garment of claim 1 including:

a retaining panel permanently attached to said back panel of said shell;

a general storage compartment formed between said retaining panel and said back panel of said shell;

a first entrance to said general storage compartment for access by the left hand;

a second entrance to said general storage compartment for access by the right hand;

means to open and close said first entrance to said general storage compartment; and means to open and close said second entrance to said general storage compartment.

4. The garment of claim 1 including:

a collar;

a hood storage compartment in said collar;

means to open and close the entrance to said hood storage compartment; and a retractable hood with a base permanently attached to the interior of said hood storage compartment, said hood being retracted into said hood storage compartment when not in use.

5. The garment of claim 1 including:

a first side panel between said left front panel and said back panel;

a second side panel between said right front panel and said back panel;

first means to adjust the fit of said vest around the midsection of the torso by constriction of said first side panel; and second means to adjust the fit of said vest around the midsection of the torso by constriction of said second panel.

6. The garment of claim 2 wherein:

said retractable safety panel is colored international orange.

7. A garment which converts from a long sleeve jacket to a vest comprising:

a shell having a back panel, a left front panel, and a right front panel;
a lining on the interior of said shell;
a pair of sleeve storage compartments encircling the arm holes formed between said shell and said lining;
means to open and close each of said compartments;
a pair of retractable sleeves with a hand opening at one end and a base at the other end, each of said bases being permanently attached to the interior of said compartments, said sleeves being folded for storage in said compartments when not in use;
a slit in each of said sleeves running their longitudinal length from the hand opening to the base;
means to open and close each of said slits;
a safety panel storage compartment, with an entrance on said back panel of said shell;
means to open and close said entrance to said safety panel storage compartment;
a retractable safety panel with a base permanently attached to the interior of said safety panel storage compartment, said safety panel being retracted into said safety panel storage compartment when not in use;
means to removably attach said safety panel to said shell when not retracted in said safety panel storage compartment;
a retaining panel permanently attached to said back panel of said shell;
a general storage compartment formed between said retaining panel and said back panel of said shell;
a first entrance to said general storage compartment for access by the left hand;
a second entrance to said general storage compartment for access by the right hand;
means to open and close said first entrance to said general storage compartment;
means to open and close said second entrance to said general storage compartment;
a collar;
a hood storage compartment in said collar;
means to open and close the entrance to said hood storage compartment;
a retractable hood with a base permanently attached to the interior of said hood storage compartment, said hood being retracted into said hood storage compartment when not in use;
a first side panel between said left front panel and said back panel;
a second side panel between said right front panel and said back panel;
first means to adjust the fit of said vest around the midsection of the torso by constriction of said first side panel; and
second means to adjust the fit of said vest around the midsection of the torso by constriction of said second panel.

8. The garment of claim 1 including:
a plurality of baffles permenantly attached to said lining and the interior of said shell; and
a thermal insulator disposed between said lining and said interior of said shell and further contained by said plurality of baffles.

9. The garment of claim 1 including:
thermal insulation disposed between said lining and said interior of said shell.

10. The garment of claim 2 wherein,
said retractable safety panel is adapted to enhance the reflection of light.

11. A garment which converts from a long sleeve jacket to a vest comprising:
a shell having a back panel, a left front panel, and a right front panel;
a lining on the interior of said shell;
a pair of circumferential compartments encircling the arm holes formed between said shell and said lining, having a first circumferential lip at the outer edge of said shell encircling said arm holes, and a second circumferential lip at the outer edge of said lining encircling said arm holes;
means to open and close said first and second lips around each of said circumferential compartments;
a pair of retractable sleeves with a circular hand opening at one end and a circular shoulder opening at the other end; said sleeves being rolled for storage in said circumferential compartments when not in use;
a third circumferential lip formed at the outer edge of each of said sleeves along said circular shoulder opening, said third lip being permanently attached along the entire circumference of said third lip inside each of said circumferential compartments;
a slit in each of said sleeves running their longitudinal length from said hand opening to said shoulder opening;
means to open and close each of said slits;
a safety panel storage compartment, with an entrance on said back panel of said shell;
means to open and close said entrance to said safety panel storage compartment;
a retractable safety panel with a base permanently attached to the interior of said safety panel storage compartment, said safety panel being retracted into said safety panel storage compartment when not in use;
means to removably attach said safety panel to said shell when not retracted in said safety panel storage compartment;
a second safety panel storage compartment with an entrance on said back panel of said shell;
means to open and close said entrance to said second safety panel storage compartment;
a second retractable safety panel permanently attached to the interior of said safety panel storage compartment, said safety panel being retracted into said safety panel storage compartment when not in use; and
means to removably attach said second safety panel to said shell when not retracted in said second safety panel storage compartment.

12. The garment of claim 12 wherein:
said retractable safety panel is colored international orange; and
said second retractable safety panel is adapted to enhance the reflection of light.

13. An outerwear garment sized and shaped for wear on the upper torso of a human person, the garment being convertible from a long sleeve jacket to an essentially sleeveless form of vest comprising:
an exterior shell being generally vest-shaped and having a neck opening at the upper end thereof, two arm openings on the left and right sides near the upper end thereof, a torso opening across the entire lower end thereof and a center front opening extending from said neck opening to said torso opening;

an interior shell having corresponding openings for neck, torso, arms, and center front as said exterior shell, and being permanently attached to the interior side of said exterior shell along a recessed seam around said arm openings and being further attached along the edges of said neck, torso and center front openings;

a circumferential compartment formed beyond said recessed seam between said exterior shell and said interior shell around each of said arm openings, having a first circumferential lip at the outer edge of said exterior shell encircling said arm opening, and a second circumferential lip at the outer edge of said interior shell encircling said arm openings;

means for opening and closing said first and said second lips around each of said circumferential compartments;

a pair of retractable sleeves sized to extend the full length of a human arm having a hand opening at one end and a shoulder opening at the other end, and being permanently attached inside each of said circumferential compartments;

said sleeves being longitudinally adapted to be folded for storage in said circumferential compartments, said first and said second circumferential lips being closed, thereby concealing said sleeves;

a safety panel storage compartment formed between said exterior shell and said interior shell having an entrance thereto located on the back of said garment;

means to open and close said entrance to said safety panel storage compartment;

a retractable safety panel with a base permanently attached to the interior of said safety panel storage compartment, said safety panel being retracted into said safety panel storage compartment when not in use; and means to removably attach said safety panel to said exterior shell when not retracted in said safety panel storage compartment.

14. The garment of claim 13 including:

a retaining panel permanently attached to said exterior shell on the back of said garment;

a general storage compartment formed between said retaining panel and exterior shell;

a first entrance to said general storage compartment for access by the left hand;

a second entrance to said general storage compartment for access by the left hand; and means to respectively open and close said first entrance and said second entrance to said general storage compartment.

15. The garment of claim 13 including:

a collar attached to said neck opening;

a hood storage compartment in said collar;

means to open and close the entrance to said hood storage compartment; and a retractable hood with a base permanently attached to the interior of said hood storage compartment, said hood being retracted into said hood storage compartment when not in use.

16. The garment of claim 13 including;

means to adjust the fit of said garment by constricting said exterior and said interior shell about the mid-section of the torso.

17. The garment of claim 13 wherein:

said retractable safety panel is colored international orange.

18. An outerwear garment sized and shaped for wear on the upper torso of a human person, the garment being convertable from a long sleeve jacket to an essentially sleeveless form of vest comprising:

an exterior shell being generally vest-shaped and having a neck opening at the upper end thereof, two arm openings on the left and right sides near the upper end thereof, a torso opening across the entire lower end thereof and a center front opening from said neck opening to said torso opening;

an interior shell having corresponding openings for neck, torso, arms, and center front as said exterior shell, and being permanently attached to the interior side of said exterior shell along an inner seam recessed from the outer circumference of said arm openings and being further attached along the edges of said neck, torso and center front openings;

a circumferential compartment formed beyond said inner seam between said exterior shell and said interior shell around each of said arm openings, having a first circumferential lip at the outer edge of said exterior shell encircling said arm opening, and a second circumferential lip at the outer edge of said interior shell encircling said arm openings;

means for opening and closing said first and said second lips around each of said circumferential compartments;

a pair of retractable sleeves sized to extend the full length of a human arm having a hand opening at one end and a shoulder opening at the other end, and being permanently attached inside each of said circumferential compartments;

said sleeves being longitudinally adapted to be folded for storage in said circumferential compartments, said first and said second circumferential lips being closed, thereby concealing said sleeves;

a safety panel storage compartment formed between said exterior shell and said interior shell having an entrance thereto located on the back of said garment;

means to open and close said entrance to said safety panel storage compartment;

a retractable safety panel with a base permanently attached to the interior of said safety panel storage compartment, said safety panel being retracted into said safety panel storage compartment when not in use;

means to removably attach said safety panel to said exterior shell when not retracted in said safety panel storage compartment;

a retaining panel permanently attached to said exterior shell on the back of said garment;

a general storage compartment formed between said retaining panel and exterior shell;

a first entrance to said general storage compartment for access by the left hand;

a second entrance to said general storage compartment for access by the left hand;

means to respectively open and close said first entrance and said second entrance to said general storage compartment;

a collar attached to said neck opening;

a hood storage compartment in said collar;

means to open and close the entrance to said hood storage compartment;

a retractable hood with a base permanently attached to the interior of said hood storage compartment, said hood being retracted into said hood storage compartment when not in use; and means to adjust the fit of said garment by constricting said exterior and said interior shell about the mid-section of the torso.

19. The garment of claim 18 including:

a plurality of baffles permanently attached to said exterior shell and said interior shell; and a thermal insulator disposed between said exterior shell and said interior shell and further contained by said plurality of baffles.

20. The garment of claim 18 including:

thermal insulation disbursed between said exterior shell and said interior shell.

21. The garment of claim 13 wherein:

said retractable safety panel is adapted to enhance the reflection of light.

22. A garment which converts from a vest to a long sleeve jacket comprising:

a shell;

a pair of sleeve storage compartments encircling the arm holes;

means to open and close each of said compartments;

a pair of retractable sleeves, said sleeves being folded for storage;

a safety panel storage compartment, with an entrance on the back of said shell;

means to open and close said entrance to said safety panel storage compartment;

a retractable safety panel with a base permanently attached to the interior of said safety panel storage compartment, said safety panel being retracted into said safety panel storage compartment when not in use; and means to removably attach said safety panel to said shell when not retracted in said safety panel storage compartment.

23. The garment of claim 22 including;

said pair of retractable sleeves having a hand opening at one end and a base at the other end, each of said bases being permanently attached to the interior of said compartments;

a slit in each of said sleeves running their longitudinal length from said hand openings to said base; and means to open and close each of said slits.

24. The garment of claim 22 including:

a retaining panel permanently attached to the back panel of said shell;

a general storage compartment formed between said retaining panel of said shell;

a first entrance to said general storage compartment for access by the left hand;

a second entrance to said general storage compartment for access by the right hand;

means to open and close said first entrance to said general storage compartment; and means to open and close said second entrance to said general storage compartment.

25. The garment of claim 22 including:

a collar;

a hood storage compartment in said collar;

means to open and close said hood storage compartment; and a retractable hood with a base permanently attached to the interior of said hood storage compartment, said hood being retracted into said hood storage compartment when not in use.

26. The garment of claim 22 including:

said shell having a back panel, a left front panel and a right front panel;

a first side panel between said left front panel and said back panel;

a second side panel between said right front panel and said back panel;

first means to adjust the fit of said garment around the midsection of the torso by constriction of said first side panel; and second means to adjust the fit of said garment around the midsection of the torso by constriction of said second panel.

27. The garment of claim 23 wherein:

said retractable safety panel is colored international orange.

28. A garment of claim 22 including:

a lining on the interior of said shell;

a plurality of baffles permanently attached to said shell and said lining; and a thermal insulator disposed between said shell and said lining and further contained by said plurality of baffles.

29. The garment of claim 22 including:

a thermal lining for insulation; and means to removably attach said lining to said interior of said shell.

30. A garment which converts from a vest to a long sleeve jacket comprising:

a shell having a back panel, a left front panel and a right front panel;

a pair of sleeve storage compartments encircling the arm holes;

means to open and close each of said compartments;

a pair of retractable sleeves with a hand opening at one end and a base at the other end, each of said bases being permanently attached to the interior of said compartments, said sleeves being folded for storage in said compartments when not in use;

a slit in each of said sleeves running their longitudinal length from said hand opening to said base;

means to open and close each of said slits;

a safety panel storage compartment, with an entrance on said back panel of said shell;

means to open and close said entrance to said safety panel storage compartment;

a retractable safety panel with a base permanently attached to the interior of said safety panel storage compartment, said safety panel being retracted into said safety panel storage compartment when not in use;

means to removably attach said safety panel to said shell when not retracted in said safety panel storage compartment;

a retaining panel permanently attached to said back panel of said shell;

a general storage compartment formed between said retaining panel and said back panel of said shell;

a first entrance to said general storage compartment for access by the left hand;

a second entrance to said general storage compartment for access by the right hand;

means to open and close said first entrance to said general storage compartment;

means to open and close said second entrance to said general storage compartment;

a collar;

a hood storage compartment in said collar;

means to open and close said hood storage compartment;

a retractable hood with a base permanently attached to the interior of said hood storage compartment, said hood being retracted into said hood storage compartment when not in use;

a first side panel between said left front panel and said back panel;

a second side panel between said right front panel and said back panel;

first means to adjust the fit of said garment around the midsection of the torso by constriction of said first side panel; and second means to adjust the fit of said garment around the midsection of the torso by constriction of said second panel.

31. The garment of claim 30 including:

a lining on the interior of said shell;

a plurality of baffles permanently attached to said lining and said shell; and a thermal insulator disposed between said lining and said interior of said shell and further contained by said plurality of baffles.

32. The garment of claim 30 including:

a thermal lining for insulation; and means to removably attach said lining to said interior of said shell.

* * * * *